US010978800B2

(12) United States Patent
Sazegar et al.

(10) Patent No.: US 10,978,800 B2
(45) Date of Patent: Apr. 13, 2021

(54) ANTENNA ELEMENT PLACEMENT FOR A CYLINDRICAL FEED ANTENNA

(71) Applicant: Kymeta, Inc., Redmond, WA (US)

(72) Inventors: Mohsen Sazegar, Kirkland, WA (US); Nathan Kundtz, Kirkland, WA (US)

(73) Assignee: KYMETA CORPORATION, Redmond, WA (US)

( * ) Notice: Subject to any disclaimer, the term of this patent is extended or adjusted under 35 U.S.C. 154(b) by 0 days.

(21) Appl. No.: 16/572,139

(22) Filed: Sep. 16, 2019

(65) Prior Publication Data

US 2020/0176866 A1 Jun. 4, 2020

Related U.S. Application Data

(63) Continuation of application No. 15/847,527, filed on Dec. 19, 2017, now Pat. No. 10,418,703, which is a (Continued)

(51) Int. Cl.
*H01Q 3/24* (2006.01)
*H01Q 3/36* (2006.01)
(Continued)

(52) U.S. Cl.
CPC ..... *H01Q 3/24* (2013.01); *H01Q 3/36* (2013.01); *H01Q 21/0012* (2013.01); (Continued)

(58) Field of Classification Search
CPC ..... H01Q 3/24; H01Q 3/36; H01Q 21/0012; H01Q 21/0025; H01Q 21/0087; H01Q 21/061; H01Q 21/064; H01Q 21/065
See application file for complete search history.

(56) References Cited

U.S. PATENT DOCUMENTS 3,063,049 A 11/1962 Kelly
5,515,060 A 5/1996 Hussain et al.
(Continued)

FOREIGN PATENT DOCUMENTS

CN 102891370 A 1/2013
CN 103222109 7/2013
(Continued)

OTHER PUBLICATIONS

Chinese Office Action for Application No. 201680013828.8 dated Jun. 17, 2020, 10 Pages.
(Continued)

*Primary Examiner* — Hoang V Nguyen
(74) *Attorney, Agent, or Firm* — Womble Bond Dickinson (US) LLP

(57) ABSTRACT

A method and apparatus is disclosed herein for antenna element placement are disclosed. In one embodiment, an antenna comprises an antenna feed to input a cylindrical feed wave; a single physical antenna aperture having at least one antenna array of antenna elements, where the antenna elements are located on a plurality of concentric rings concentrically located relative to an antenna feed, wherein rings of the plurality of concentric rings are separated by a ring-to-ring distance, wherein a first distance between elements along rings of the plurality of concentric rings is a function of a second distance between rings of the plurality of concentric rings; and a controller to control each antenna element of the array separately using matrix drive circuitry, where each of the antenna elements is uniquely addressed by the matrix drive circuitry.

13 Claims, 15 Drawing Sheets

Related U.S. Application Data continuation of application No. 15/059,837, filed on Mar. 3, 2016, now Pat. No. 9,905,921.

(60) Provisional application No. 62/128,894, filed on Mar. 5, 2015, provisional application No. 62/128,896, filed on Mar. 5, 2015, provisional application No. 62/136,356, filed on Mar. 20, 2015, provisional application No. 62/153,394, filed on Apr. 27, 2015.

(51) Int. Cl.
*H01Q 21/00* (2006.01)
*H01Q 21/06* (2006.01)
*H01P 1/18* (2006.01)

(52) U.S. Cl.
CPC ..... *H01Q 21/0025* (2013.01); *H01Q 21/0087* (2013.01); *H01Q 21/061* (2013.01); *H01Q 21/064* (2013.01); *H01Q 21/065* (2013.01); *H01P 1/18* (2013.01)

(56) References Cited

U.S. PATENT DOCUMENTS

| | | | |
|---|---|---|---|
| 6,404,401 | B2 | 6/2002 | Gilbert et al. |
| 6,707,433 | B2 | 3/2004 | Ohtsuka et al. |
| 6,778,148 | B1 | 8/2004 | Pack |
| 6,842,157 | B2 | 1/2005 | Phelan et al. |
| 7,233,297 | B1 | 6/2007 | Harvey et al. |
| 2003/0090433 | A1 | 5/2003 | Ohtsuka et al. |
| 2003/0184478 | A1 | 10/2003 | Kingsley et al. |
| 2004/0051678 | A1 | 3/2004 | Ohtsuka et al. |
| 2007/0033592 | A1 | 2/2007 | Roediger et al. |
| 2008/0204326 | A1 | 8/2008 | Zeinolabedin Rati et al. |
| 2012/0194399 | A1* | 8/2012 | Bily ..... H01Q 15/0006 343/772 |
| 2012/0280770 | A1 | 11/2012 | Abhari et al. |
| 2013/0069831 | A1 | 3/2013 | Friedman et al. |
| 2014/0266946 | A1 | 9/2014 | Bily et al. |
| 2014/0354498 | A1 | 12/2014 | Balma et al. |
| 2015/0009068 | A1 | 1/2015 | Gregoire et al. |
| 2015/0236412 | A1 | 8/2015 | Bily et al. |

FOREIGN PATENT DOCUMENTS

| | | |
|---|---|---|
| JP | 02-214308 | 8/1990 |
| JP | 2006-005432 | 1/2006 |
| JP | 2007-243352 | 9/2007 |
| JP | 2013-539949 | 10/2013 |

OTHER PUBLICATIONS

Korean Office Action for Application No. 10-2018-7021787 dated Apr. 11, 2019, 7 pages.

Extended European Search Report for Application No. 16759615.4 dated Oct. 9, 2018, 10 pages.

Paul W Davis et al, "Experimental Investigations into a Linearly Polarized Radial Slot Antenna for DBS TV in Australia" IEEE Transactions on Antennas and Propagation, IEEE Service Center, Piscataway, NJ, US vol. 45, No. 7, Jul. 7, 1997.

Chinese Office Action for Application No. 201680013828.8,dated Nov. 4, 2019, 9 pages.

Yuan, Cheng-Wei, et al., "Designs and Experiments of a Novel Radial Line Slot Antenna for High-Power Microwave Application," IEEE Transactions on Antennas and Propagation (vol. 61, Issue 10, Oct. 2017) pp. 4960-4946.

Chinese Office Action and Search Report on the Patentability of Application No. 201680013828.8, dated Oct. 19, 2020, 5 pages.

* cited by examiner

Iris L2

Iris L1

Patch and Iris L1

Top View

ANTENNA ELEMENT PLACEMENT FOR A CYLINDRICAL FEED ANTENNA

PRIORITY

The present patent application is a continuation of U.S. patent application Ser. No. 15/847,527, titled "Antenna Element Placement for a Cylindrical Feed Antenna," filed on Dec. 19, 2017, which is a continuation of U.S. patent application Ser. No. 15/059,837, titled "Antenna Element Placement for a Cylindrical Feed Antenna," filed on Mar. 3, 2016 which claims priority to and incorporates by reference the corresponding provisional patent application Ser. Nos. 62/128,894, titled, "Cell Placement with Predefined Matrix Drive Circuitry for Cylindrical Feed," filed on Mar. 5, 2015; 62/128,896, titled "Vortex Matrix Drive Lattice for Cylindrical Feed Antennas," filed on Mar. 5, 2015; 62/136,356, titled "Aperture Segmentation of a Cylindrical Feed Antenna," filed on Mar. 20, 2015; and 62/153,394, titled "A Metamaterial Antenna System for Communications Satellite Earth Stations", filed Apr. 27, 2015.

RELATED APPLICATIONS

This application is related to the co-pending application entitled "Aperture Segmentation of a Cylindrical Feed Antenna", concurrently filed on Mar. 3, 2016, U.S. patent application Ser. No. 15/059,843, assigned to the corporate assignee of the present invention.

FIELD OF THE INVENTION

Embodiments of the present invention relate to the field of antennas; more particularly, embodiments of the present invention relate to antenna element placement for antenna apertures and segmentation of such apertures for antennas, such as, for example, cylindrically fed antennas.

BACKGROUND OF THE INVENTION

The fabrication of very large antennas regardless of the technology used often approaches the limits of the technology in size and leads ultimately to very high fabrication costs. Furthermore, a small error in a large antenna can result in a failure of the antenna product. This is the reason certain technology approaches that might be used in other industries cannot be readily applied to antenna fabrication. One such technology is active matrix technologies.

Active matrix technologies have been used to drive liquid crystal displays. In such technologies, one transistor is coupled to each liquid crystal cell and each liquid crystal cell can be selected by applying a voltage to a select signal coupled to the gate of the transistor. Many different types of transistors are used, including thin-film transistors (TFT). In the case of TFT, the active matrix is referred to as a TFT active matrix.

The active matrix uses addresses and drive circuitry to control each of the liquid crystal cells in the array. To ensure each of the liquid crystal cells are uniquely addressed, the matrix uses rows and columns of conductors to create connections for the selection transistors.

The use of matrix drive circuitry has been proposed for use with antennas. However, using rows and columns of conductors may be useful in antenna arrays that have antenna elements that are arranged in rows and columns but may not be feasible when the antenna elements are not arranged in that manner.

Tiling or segmentation is a common method of fabricating phased array and static array antennas to help reduce the issues associated with fabricating such antennas. When fabricating large antenna arrays, the large antenna arrays are usually segmented into LRUs (Line Replaceable Units) that are identical segments. Aperture tiling or segmentation is very common for large antennas, especially for complex systems such as phased arrays. However, no application of segmentation has been found that provides a tiling approach for cylindrical feed antennas.

SUMMARY OF THE INVENTION

A method and apparatus is disclosed herein for antenna element placement are disclosed. In one embodiment, an antenna comprises an antenna feed to input a cylindrical feed wave; a single physical antenna aperture having at least one antenna array of antenna elements, where the antenna elements are located on a plurality of concentric rings concentrically located relative to an antenna feed, wherein rings of the plurality of concentric rings are separated by a ring-to-ring distance, wherein a first distance between elements along rings of the plurality of concentric rings is a function of a second distance between rings of the plurality of concentric rings; and a controller to control each antenna element of the array separately using matrix drive circuitry, where each of the antenna elements is uniquely addressed by the matrix drive circuitry.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION OF THE PRESENT INVENTION

Figure 1A:
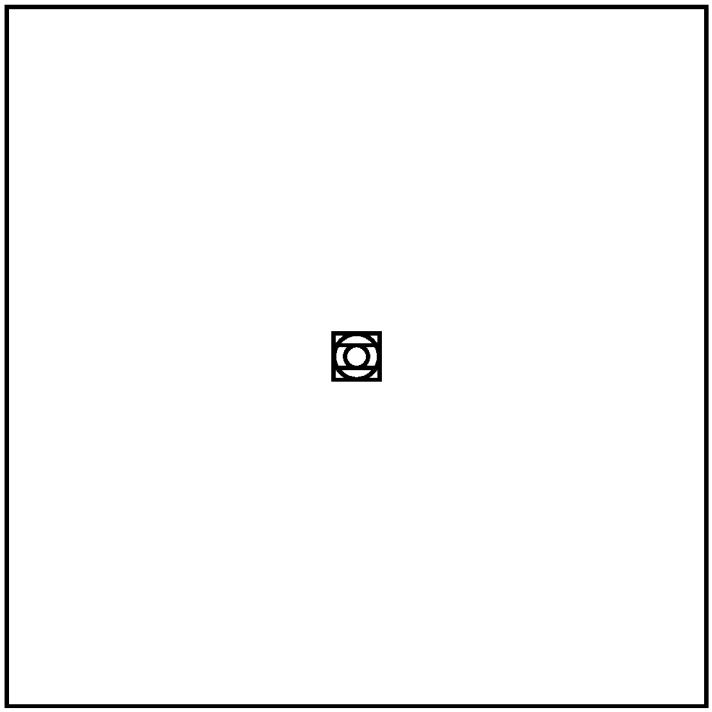
FIG. 1A illustrates a top view of one embodiment of a coaxial feed that is used to provide a cylindrical wave feed.

Embodiments of flat panel antennas are disclosed. The flat panel antennas include one or more arrays of antenna elements on an antenna aperture. In one embodiment, the antenna elements comprises liquid crystal cells. In one embodiment, the flat panel antenna is a cylindrically fed antenna that includes matrix drive circuitry to uniquely address and drive each of the antenna elements that are not placed in rows and columns. In one embodiment, the elements are placed in rings.

In one embodiment, the antenna aperture having the one or more arrays of antenna elements is comprised of multiple segments coupled together. When coupled together, the combination of the segments form closed concentric rings of antenna elements. In one embodiment, the concentric rings are concentric with respect to the antenna feed.

In the following description, numerous details are set forth to provide a more thorough explanation of the present invention. It will be apparent, however, to one skilled in the art, that the present invention may be practiced without these specific details. In other instances, well-known structures and devices are shown in block diagram form, rather than in detail, in order to avoid obscuring the present invention.

Some portions of the detailed descriptions that follow are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

Overview of an Example of the Antenna System

In one embodiment, the flat panel antenna is part of a metamaterial antenna system. Embodiments of a metamaterial antenna system for communications satellite earth stations are described. In one embodiment, the antenna system is a component or subsystem of a satellite earth station (ES) operating on a mobile platform (e.g., aeronautical, maritime, land, etc.) that operates using either Ka-band frequencies or Ku-band frequencies for civil commercial satellite communications. Note that embodiments of the antenna system also can be used in earth stations that are not on mobile platforms (e.g., fixed or transportable earth stations).

In one embodiment, the antenna system uses surface scattering metamaterial technology to form and steer transmit and receive beams through separate antennas. In one embodiment, the antenna systems are analog systems, in contrast to antenna systems that employ digital signal processing to electrically form and steer beams (such as phased array antennas).

In one embodiment, the antenna system is comprised of three functional subsystems: (1) a wave guiding structure consisting of a cylindrical wave feed architecture; (2) an array of wave scattering metamaterial unit cells that are part of antenna elements; and (3) a control structure to command formation of an adjustable radiation field (beam) from the metamaterial scattering elements using holographic principles.

Examples of Wave Guiding Structures

FIG. 1A illustrates a top view of one embodiment of a coaxial feed that is used to provide a cylindrical wave feed. Referring to FIG. 1A, the coaxial feed includes a center conductor and an outer conductor. In one embodiment, the cylindrical wave feed architecture feeds the antenna from a central point with an excitation that spreads outward in a cylindrical manner from the feed point. That is, a cylindrically fed antenna creates an outward travelling concentric feed wave. Even so, the shape of the cylindrical feed antenna around the cylindrical feed can be circular, square or any shape. In another embodiment, a cylindrically fed antenna creates an inward travelling feed wave. In such a case, the feed wave most naturally comes from a circular structure.

Figure 1B:
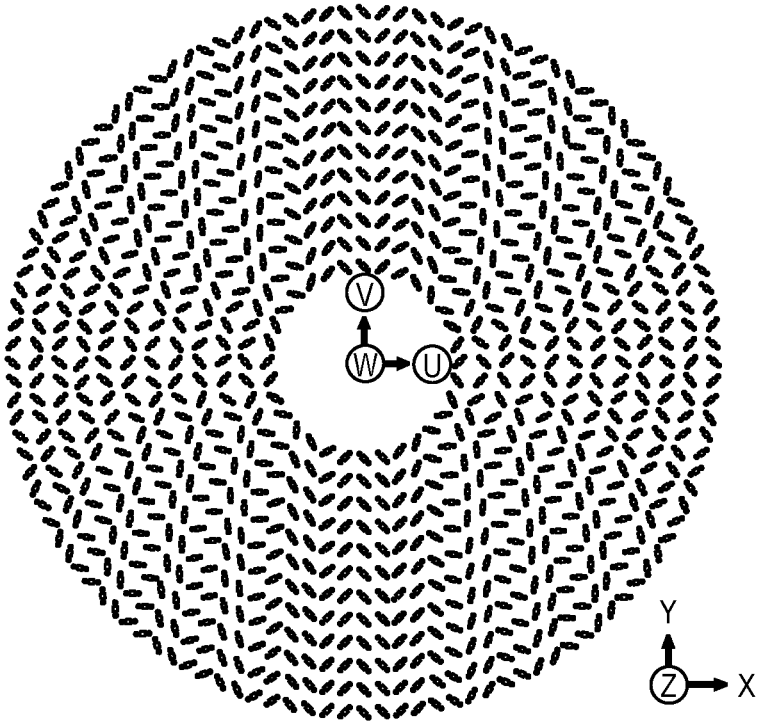
FIG. 1B illustrates an aperture having one or more arrays of antenna elements placed in concentric rings around an input feed of the cylindrically fed antenna.

FIG. 1B illustrates an aperture having one or more arrays of antenna elements placed in concentric rings around an input feed of the cylindrically fed antenna.

Antenna Elements

In one embodiment, the antenna elements comprise a group of patch and slot antennas (unit cells). This group of unit cells comprises an array of scattering metamaterial elements. In one embodiment, each scattering element in the antenna system is part of a unit cell that consists of a lower conductor, a dielectric substrate and an upper conductor that embeds a complementary electric inductive-capacitive resonator ("complementary electric LC" or "CELC") that is etched in or deposited onto the upper conductor.

In one embodiment, a liquid crystal (LC) is disposed in the gap around the scattering element. Liquid crystal is encapsulated in each unit cell and separates the lower conductor associated with a slot from an upper conductor associated with its patch. Liquid crystal has a permittivity that is a function of the orientation of the molecules comprising the liquid crystal, and the orientation of the molecules (and thus the permittivity) can be controlled by adjusting the bias voltage across the liquid crystal. Using this property, in one embodiment, the liquid crystal integrates an on/off switch and intermediate states between on and off for the transmission of energy from the guided wave to the CELC. When switched on, the CELC emits an electromagnetic wave like an electrically small dipole antenna. Note that the teachings herein are not limited to having a liquid crystal that operates in a binary fashion with respect to energy transmission.

In one embodiment, the feed geometry of this antenna system allows the antenna elements to be positioned at forty five degree (45°) angles to the vector of the wave in the wave feed. Note that other positions may be used (e.g., at 40° angles). This position of the elements enables control of the free space wave received by or transmitted/radiated from the elements. In one embodiment, the antenna elements are arranged with an inter-element spacing that is less than a free-space wavelength of the operating frequency of the antenna. For example, if there are four scattering elements per wavelength, the elements in the 30 GHz transmit antenna will be approximately 2.5 mm (i.e., ¼th the 10 mm free-space wavelength of 30 GHz).

In one embodiment, the two sets of elements are perpendicular to each other and simultaneously have equal amplitude excitation if controlled to the same tuning state. Rotating them +/−45 degrees relative to the feed wave excitation achieves both desired features at once. Rotating one set 0 degrees and the other 90 degrees would achieve the perpendicular goal, but not the equal amplitude excitation goal. Note that 0 and 90 degrees may be used to achieve isolation when feeding the array of antenna elements in a single structure from two sides as described above.

The amount of radiated power from each unit cell is controlled by applying a voltage to the patch (potential across the LC channel) using a controller. Traces to each patch are used to provide the voltage to the patch antenna. The voltage is used to tune or detune the capacitance and thus the resonance frequency of individual elements to effectuate beam forming. The voltage required is dependent on the liquid crystal mixture being used. The voltage tuning characteristic of liquid crystal mixtures is mainly described by a threshold voltage at which the liquid crystal starts to be affected by the voltage and the saturation voltage, above which an increase of the voltage does not cause major tuning in liquid crystal. These two characteristic parameters can change for different liquid crystal mixtures.

In one embodiment, a matrix drive is used to apply voltage to the patches in order to drive each cell separately from all the other cells without having a separate connection for each cell (direct drive). Because of the high density of elements, the matrix drive is the most efficient way to address each cell individually.

In one embodiment, the control structure for the antenna system has 2 main components: the controller, which includes drive electronics for the antenna system, is below the wave scattering structure, while the matrix drive switching array is interspersed throughout the radiating RF array in such a way as to not interfere with the radiation. In one embodiment, the drive electronics for the antenna system comprise commercial off-the-shelf LCD controls used in commercial television appliances that adjust the bias voltage for each scattering element by adjusting the amplitude of an AC bias signal to that element.

In one embodiment, the controller also contains a microprocessor executing software. The control structure may also incorporate sensors (e.g., a GPS receiver, a three axis compass, a 3-axis accelerometer, 3-axis gyro, 3-axis magnetometer, etc.) to provide location and orientation information to the processor. The location and orientation information may be provided to the processor by other systems in the earth station and/or may not be part of the antenna system.

More specifically, the controller controls which elements are turned off and which elements are turned on and at which phase and amplitude level at the frequency of operation. The elements are selectively detuned for frequency operation by voltage application.

For transmission, a controller supplies an array of voltage signals to the RF patches to create a modulation, or control pattern. The control pattern causes the elements to be turned to different states. In one embodiment, multistate control is used in which various elements are turned on and off to varying levels, further approximating a sinusoidal control pattern, as opposed to a square wave (i.e., a sinusoid gray shade modulation pattern). In one embodiment, some elements radiate more strongly than others, rather than some elements radiate and some do not. Variable radiation is achieved by applying specific voltage levels, which adjusts the liquid crystal permittivity to varying amounts, thereby detuning elements variably and causing some elements to radiate more than others.

The generation of a focused beam by the metamaterial array of elements can be explained by the phenomenon of constructive and destructive interference. Individual electromagnetic waves sum up (constructive interference) if they have the same phase when they meet in free space and waves cancel each other (destructive interference) if they are in opposite phase when they meet in free space. If the slots in a slotted antenna are positioned so that each successive slot is positioned at a different distance from the excitation point of the guided wave, the scattered wave from that element will have a different phase than the scattered wave of the previous slot. If the slots are spaced one quarter of a guided wavelength apart, each slot will scatter a wave with a one fourth phase delay from the previous slot.

Using the array, the number of patterns of constructive and destructive interference that can be produced can be increased so that beams can be pointed theoretically in any direction plus or minus ninety degrees (90°) from the bore sight of the antenna array, using the principles of holography. Thus, by controlling which metamaterial unit cells are turned on or off (i.e., by changing the pattern of which cells are turned on and which cells are turned off), a different pattern of constructive and destructive interference can be produced, and the antenna can change the direction of the main beam. The time required to turn the unit cells on and off dictates the speed at which the beam can be switched from one location to another location.

In one embodiment, the antenna system produces one steerable beam for the uplink antenna and one steerable beam for the downlink antenna. In one embodiment, the antenna system uses metamaterial technology to receive beams and to decode signals from the satellite and to form transmit beams that are directed toward the satellite. In one embodiment, the antenna systems are analog systems, in contrast to antenna systems that employ digital signal processing to electrically form and steer beams (such as phased array antennas). In one embodiment, the antenna system is considered a "surface" antenna that is planar and relatively low profile, especially when compared to conventional satellite dish receivers.

Figure 2:
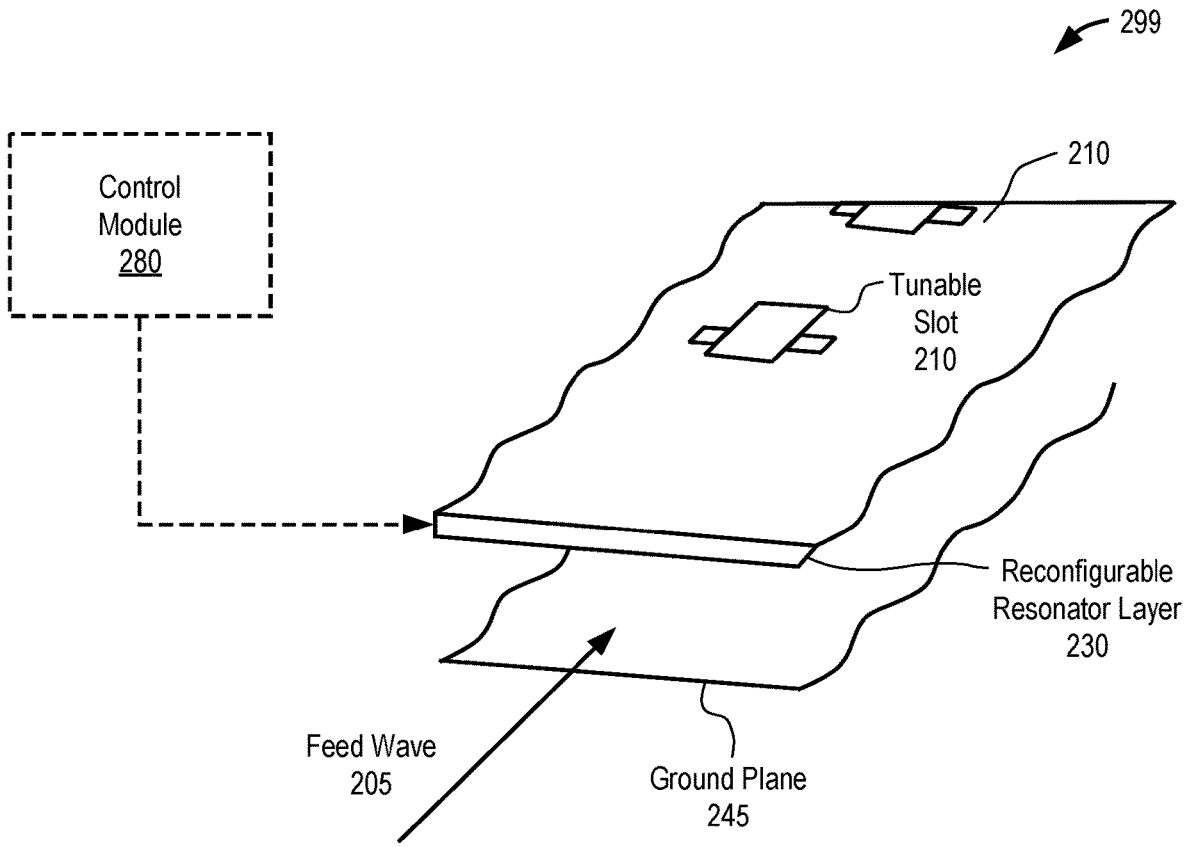
FIG. 2 illustrates a perspective view of one row of antenna elements that includes a ground plane and a reconfigurable resonator layer.

FIG. 2 illustrates a perspective view of one row of antenna elements that includes a ground plane and a reconfigurable resonator layer. Reconfigurable resonator layer 230 includes an array of tunable slots 210. The array of tunable slots 210 can be configured to point the antenna in a desired direction. Each of the tunable slots can be tuned/adjusted by varying a voltage across the liquid crystal.

Control module 280 is coupled to reconfigurable resonator layer 230 to modulate the array of tunable slots 210 by varying the voltage across the liquid crystal in FIG. 2. Control module 280 may include a Field Programmable Gate Array ("FPGA"), a microprocessor, a controller, System-on-a-Chip (SoC), or other processing logic. In one embodiment, control module 280 includes logic circuitry (e.g., multiplexer) to drive the array of tunable slots 210. In one embodiment, control module 280 receives data that includes specifications for a holographic diffraction pattern to be driven onto the array of tunable slots 210. The holographic diffraction patterns may be generated in response to a spatial relationship between the antenna and a satellite so that the holographic diffraction pattern steers the downlink beams (and uplink beam if the antenna system performs transmit) in the appropriate direction for communication. Although not drawn in each figure, a control module similar to control module 280 may drive each array of tunable slots described in the figures of the disclosure.

Radio Frequency ("RF") holography is also possible using analogous techniques where a desired RF beam can be generated when an RF reference beam encounters an RF holographic diffraction pattern. In the case of satellite communications, the reference beam is in the form of a feed wave, such as feed wave 205 (approximately 20 GHz in some embodiments). To transform a feed wave into a radiated beam (either for transmitting or receiving purposes), an interference pattern is calculated between the desired RF beam (the object beam) and the feed wave (the reference beam). The interference pattern is driven onto the array of tunable slots 210 as a diffraction pattern so that the feed wave is "steered" into the desired RF beam (having the desired shape and direction). In other words, the feed wave encountering the holographic diffraction pattern "reconstructs" the object beam, which is formed according to design requirements of the communication system. The holographic diffraction pattern contains the excitation of each element and is calculated by $w_{hologram}=w^*_{in}w_{out}$, with $w_{in}$ as the wave equation in the waveguide and $w_{out}$ the wave equation on the outgoing wave.

Figure 3:
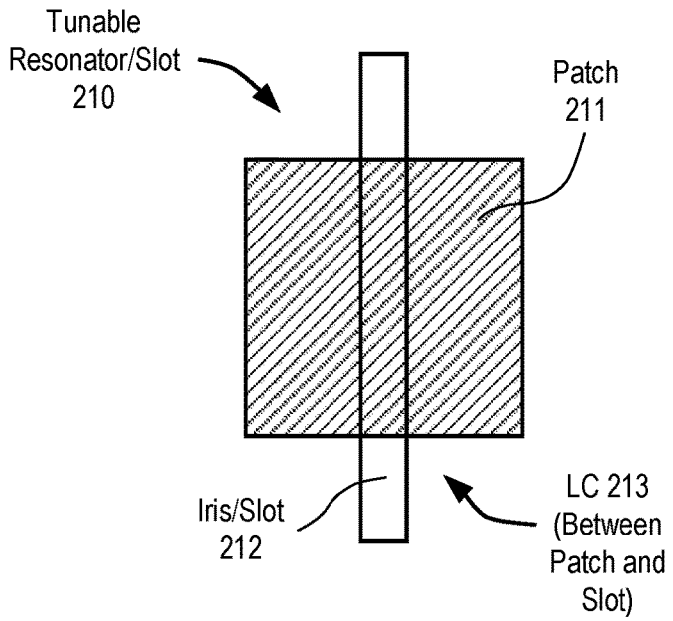
FIG. 3 illustrates one embodiment of a tunable resonator/slot.

FIG. 3 illustrates one embodiment of a tunable resonator/slot 210. Tunable slot 210 includes an iris/slot 212, a radiating patch 211, and liquid crystal 213 disposed between iris 212 and patch 211. In one embodiment, radiating patch 211 is co-located with iris 212.

Figure 4:
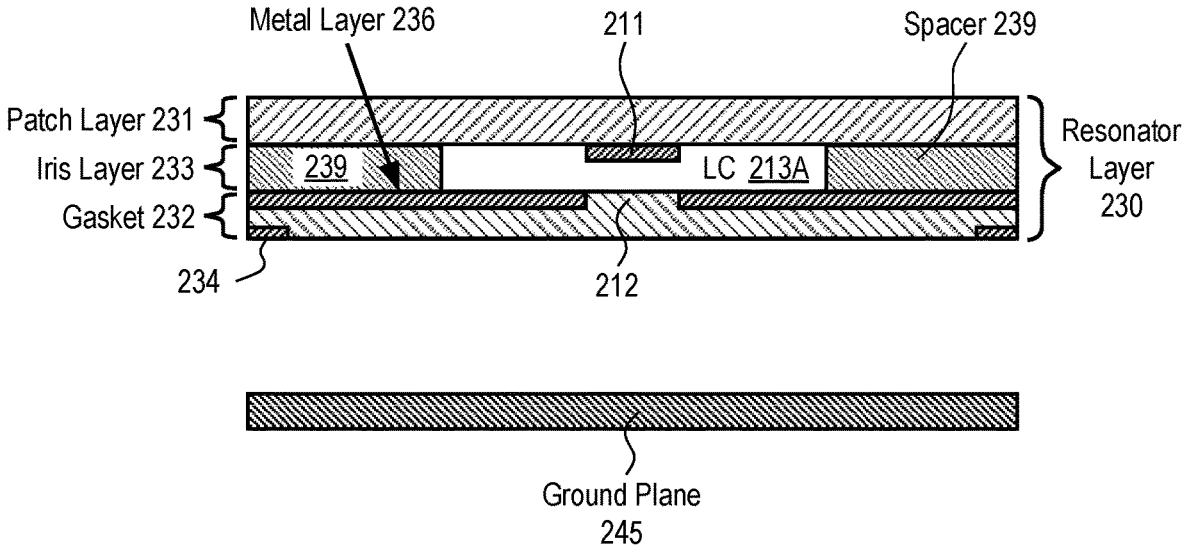
FIG. 4 illustrates a cross section view of one embodiment of a physical antenna aperture.

FIG. 4 illustrates a cross section view of a physical antenna aperture, in accordance with an embodiment of the disclosure. The antenna aperture includes ground plane 245, and a metal layer 236 within iris layer 233, which is included in reconfigurable resonator layer 230. In one embodiment, the antenna aperture of FIG. 4 includes a plurality of tunable resonator/slots 210 of FIG. 3. Iris/slot 212 is defined by openings in metal layer 236. A feed wave, such as feed wave 205 of FIG. 2, may have a microwave frequency compatible with satellite communication channels. The feed wave propagates between ground plane 245 and resonator layer 230.

Reconfigurable resonator layer 230 also includes gasket layer 232 and patch layer 231. Gasket layer 232 is disposed between patch layer 231 and iris layer 233. Note that in one embodiment, a spacer could replace gasket layer 232. In one embodiment, Iris layer 233 is a printed circuit board ("PCB") that includes a copper layer as metal layer 236. In one embodiment, iris layer 233 is glass. Iris layer 233 may be other types of substrates.

Openings may be etched in the copper layer to form slots 212. In one embodiment, iris layer 233 is conductively coupled by a conductive bonding layer to another structure (e.g., a waveguide) in FIG. 4. Note that in an embodiment the iris layer is not conductively coupled by a conductive bonding layer and is instead interfaced with a non-conducting bonding layer.

Patch layer 231 may also be a PCB that includes metal as radiating patches 211. In one embodiment, gasket layer 232 includes spacers 239 that provide a mechanical standoff to define the dimension between metal layer 236 and patch 211. In one embodiment, the spacers are 75 microns, but other sizes may be used (e.g., 3-200 mm). As mentioned above, in one embodiment, the antenna aperture of FIG. 4 includes multiple tunable resonator/slots, such as tunable resonator/slot 210 includes patch 211, liquid crystal 213, and iris 212 of FIG. 3. The chamber for liquid crystal 213 is defined by spacers 239, iris layer 233 and metal layer 236. When the chamber is filled with liquid crystal, patch layer 231 can be laminated onto spacers 239 to seal liquid crystal within resonator layer 230.

A voltage between patch layer 231 and iris layer 233 can be modulated to tune the liquid crystal in the gap between the patch and the slots (e.g., tunable resonator/slot 210). Adjusting the voltage across liquid crystal 213 varies the capacitance of a slot (e.g., tunable resonator/slot 210). Accordingly, the reactance of a slot (e.g., tunable resonator/slot 210) can be varied by changing the capacitance. Resonant frequency of slot 210 also changes according to the equation $$f = \frac{1}{2\pi\sqrt{LC}}$$

where f is the resonant frequency of slot 210 and L and C are the inductance and capacitance of slot 210, respectively. The resonant frequency of slot 210 affects the energy radiated from feed wave 205 propagating through the waveguide. As an example, if feed wave 205 is 20 GHz, the resonant frequency of a slot 210 may be adjusted (by varying the capacitance) to 17 GHz so that the slot 210 couples substantially no energy from feed wave 205. Or, the resonant frequency of a slot 210 may be adjusted to 20 GHz so that the slot 210 couples energy from feed wave 205 and radiates that energy into free space. Although the examples given are binary (fully radiating or not radiating at all), full grey scale control of the reactance, and therefore the resonant frequency of slot 210 is possible with voltage variance over a multi-valued range. Hence, the energy radiated from each slot 210 can be finely controlled so that detailed holographic diffraction patterns can be formed by the array of tunable slots.

In one embodiment, tunable slots in a row are spaced from each other by $\lambda/5$. Other spacings may be used. In one embodiment, each tunable slot in a row is spaced from the closest tunable slot in an adjacent row by $\lambda/2$, and, thus, commonly oriented tunable slots in different rows are spaced by λ/4, though other spacings are possible (e.g., λ/5, λ/6.3). In another embodiment, each tunable slot in a row is spaced from the closest tunable slot in an adjacent row by λ/3.

Embodiments of this invention use reconfigurable metamaterial technology, such as described in U.S. patent application Ser. No. 14/550,178, entitled "Dynamic Polarization and Coupling Control from a Steerable Cylindrically Fed Holographic Antenna", filed Nov. 21, 2014 and U.S. patent application Ser. No. 14/610,502, entitled "Ridged Waveguide Feed Structures for Reconfigurable Antenna", filed Jan. 30, 2015, to the multi-aperture needs of the marketplace.

Figure 5A:
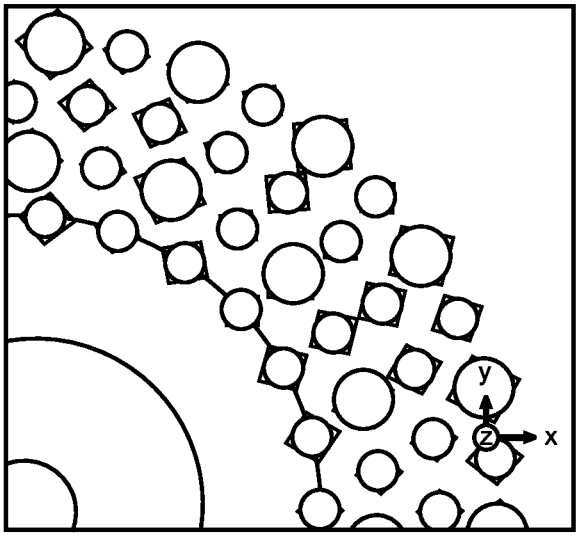
FIGS. 5A-D illustrate one embodiment of the different layers for creating the slotted array.
Figure 5B:
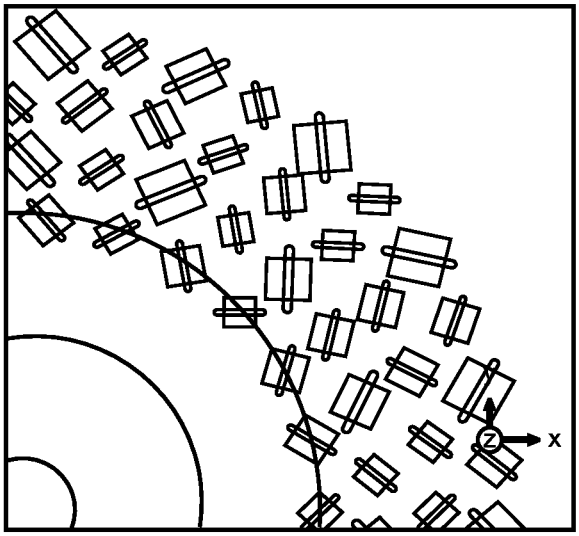
Figure 5C:
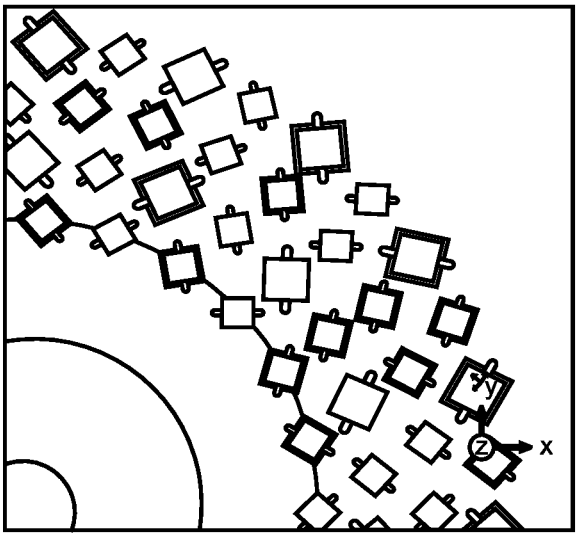
Figure 5D:
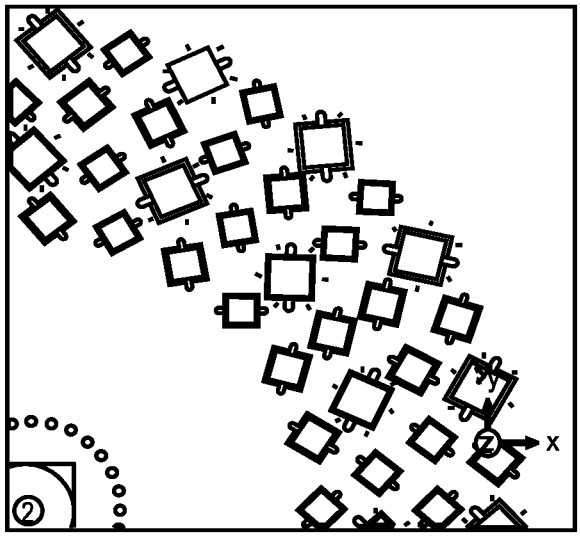

FIGS. 5A-D illustrate one embodiment of the different layers for creating the slotted array. Note that in this example the antenna array has two different types of antenna elements that are used for two different types of frequency bands. FIG. 5A illustrates a portion of the first iris board layer with locations corresponding to the slots. Referring to FIG. 5A, the circles are open areas/slots in the metallization in the bottom side of the iris substrate, and are for controlling the coupling of elements to the feed (the feed wave). Note that this layer is an optional layer and is not used in all designs. FIG. 5B illustrates a portion of the second iris board layer containing slots. FIG. 5C illustrates patches over a portion of the second iris board layer. FIG. 5D illustrates a top view of a portion of the slotted array.

Figure 6:
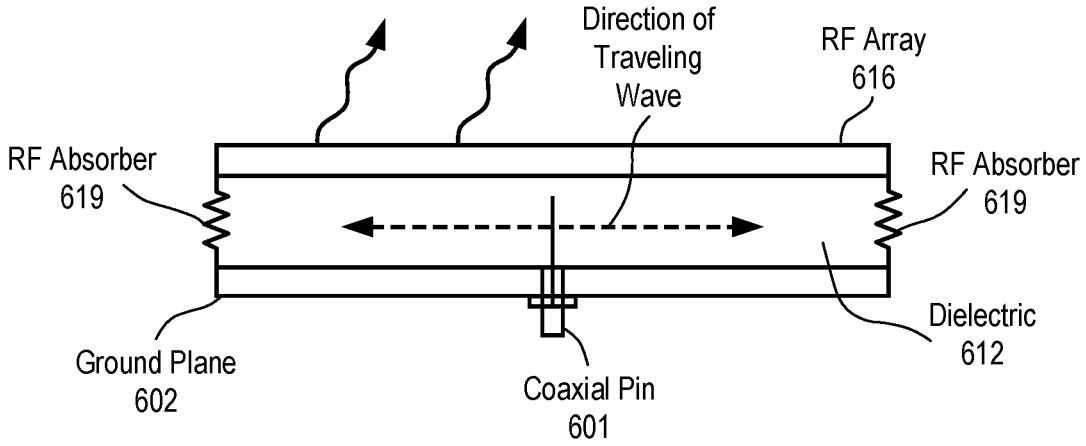
FIG. 6 illustrates another embodiment of the antenna system with a cylindrical feed producing an outgoing wave.

FIG. 6 illustrates another embodiment of the antenna system with a cylindrical feed producing an outgoing wave. Referring to FIG. 6, a ground plane 602 is substantially parallel to an RF array 616 with a dielectric layer 612 (e.g., a plastic layer, etc.) in between them. RF absorbers 619 (e.g., resistors) couple the ground plane 602 and RF array 616 together. In one embodiment, dielectric layer 612 has a dielectric constant of 2-4. In one embodiment, RF array 616 includes the antenna elements as described in conjunction with FIGS. 2-4. A coaxial pin 601 (e.g., 50Ω) feeds the antenna.

In operation, a feed wave is fed through coaxial pin 601 and travels concentrically outward and interacts with the elements of RF array 616.

In other embodiments, the feed wave is fed from the edge, and interacts the elements of RF array 616. An example of such an edge-fed antenna aperture is discussed in U.S. patent application Ser. No. 14/550,178, entitled "Dynamic Polarization and Coupling Control from a Steerable Cylindrically Fed Holographic Antenna", filed Nov. 21, 2014.

The cylindrical feed in the antenna of FIG. 6 improves the scan angle of the antenna over other prior art antennas. Instead of a scan angle of plus or minus forty five degrees azimuth (±45° Az) and plus or minus twenty five degrees elevation (±25° El), in one embodiment, the antenna system has a scan angle of seventy five degrees (75°) from the bore sight in all directions. As with any beam forming antenna comprised of many individual radiators, the overall antenna gain is dependent on the gain of the constituent elements, which themselves are angle-dependent. When using common radiating elements, the overall antenna gain typically decreases as the beam is pointed further off bore sight. At 75 degrees off bore sight, significant gain degradation of about 6 dB is expected.

Cell Placement

In one embodiment, the antenna elements are placed on the cylindrical feed antenna aperture in a way that allows for a systematic matrix drive circuit. The placement of the cells includes placement of the transistors for the matrix drive.

Figure 17:
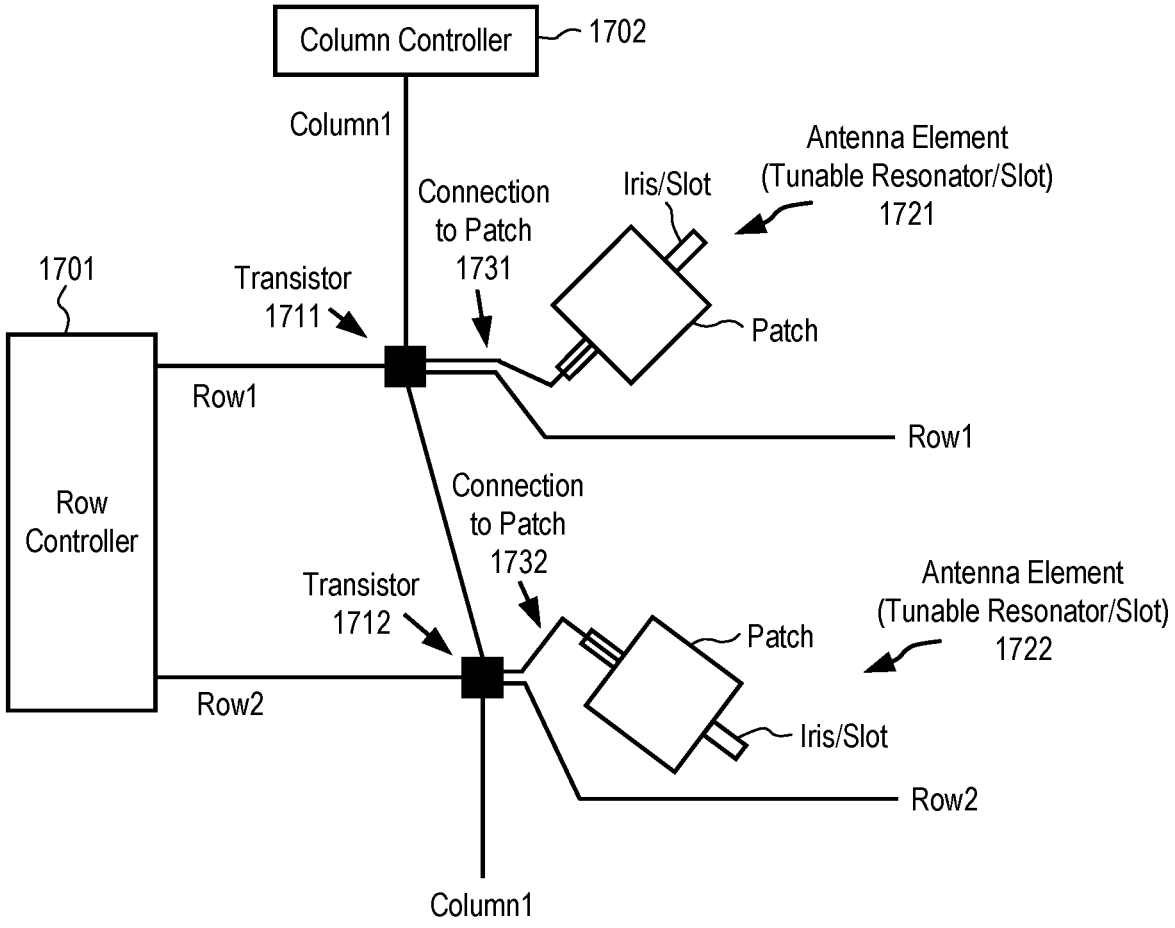
FIG. 17 illustrates one embodiment of the placement of matrix drive circuitry with respect to antenna elements.

FIG. 17 illustrates one embodiment of the placement of matrix drive circuitry with respect to antenna elements. Referring to FIG. 17, row controller 1701 is coupled to transistors 1711 and 1712, via row select signals Row1 and Row2, respectively, and column controller 1702 is coupled to transistors 1711 and 1712 via column select signal Column1. Transistor 1711 is also coupled to antenna element 1721 via connection to patch 1731, while transistor 1712 is coupled to antenna element 1722 via connection to patch 1732.

In an initial approach to realize matrix drive circuitry on the cylindrical feed antenna with unit cells placed in a non-regular grid, two steps are performed. In the first step, the cells are placed on concentric rings and each of the cells is connected to a transistor that is placed beside the cell and acts as a switch to drive each cell separately. In the second step, the matrix drive circuitry is built in order to connect every transistor with a unique address as the matrix drive approach requires. Because the matrix drive circuit is built by row and column traces (similar to LCDs) but the cells are placed on rings, there is no systematic way to assign a unique address to each transistor. This mapping problem results in very complex circuitry to cover all the transistors and leads to a significant increase in the number of physical traces to accomplish the routing. Because of the high density of cells, those traces disturb the RF performance of the antenna due to coupling effect. Also, due to the complexity of traces and high packing density, the routing of the traces cannot be accomplished by commercial available layout tools.

In one embodiment, the matrix drive circuitry is predefined before the cells and transistors are placed. This ensures a minimum number of traces that are necessary to drive all the cells, each with a unique address. This strategy reduces the complexity of the drive circuitry and simplifies the routing, which subsequently improves the RF performance of the antenna.

More specifically, in one approach, in the first step, the cells are placed on a regular rectangular grid composed of rows and columns that describe the unique address of each cell. In the second step, the cells are grouped and transformed to concentric circles while maintaining their address and connection to the rows and columns as defined in the first step. A goal of this transformation is not only to put the cells on rings but also to keep the distance between cells and the distance between rings constant over the entire aperture. In order to accomplish this goal, there are several ways to group the cells.

Figure 7:
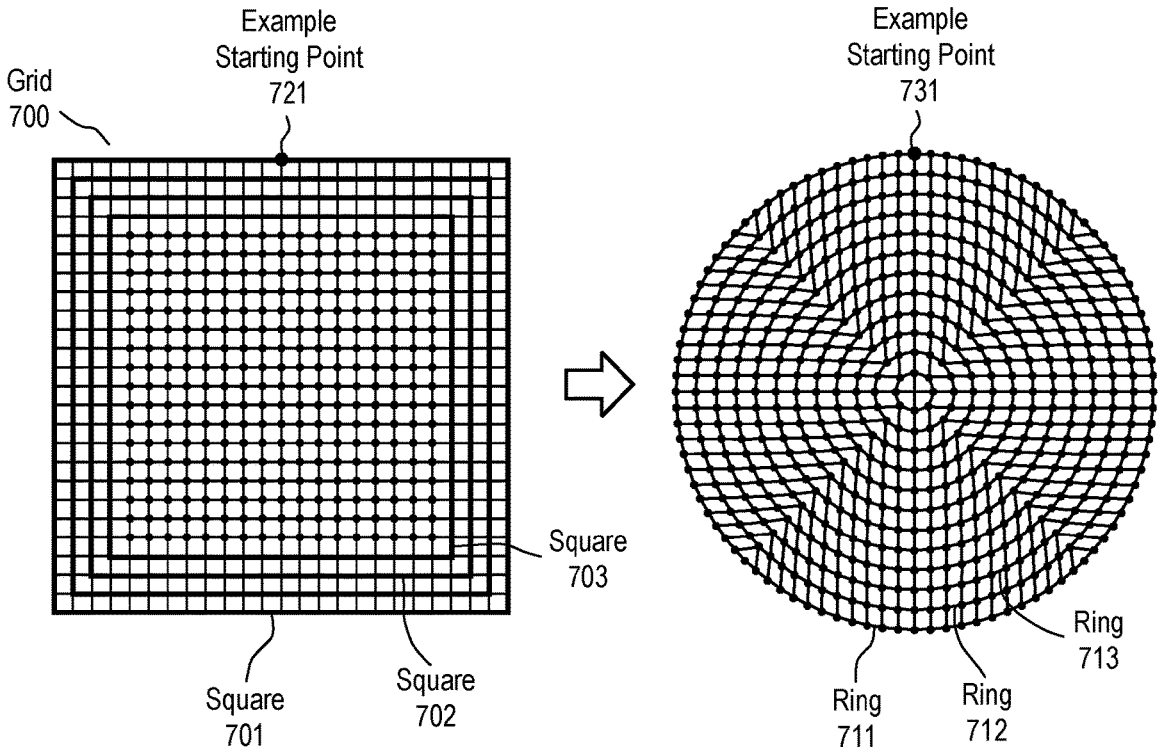
FIG. 7 shows an example where cells are grouped to form concentric squares (rectangles).

FIG. 7 shows an example where cells are grouped to form concentric squares (rectangles). Referring to FIG. 7, squares 701-703 are shown on the grid 700 of rows and columns. Note that these are examples of the squares and not all of the squares to create the cell placement on the right side of FIG. 7. Each of the squares, such as squares 701-703, are then, through a mathematical conformal mapping process, transformed into rings, such as rings 711-713 of antenna elements. For example, the outer ring 711 is the transformation of the outer square 701 on the left.

The density of the cells after the transformation is determined by the number of cells that the next larger square contains in addition to the previous square. In one embodiment, using squares results in the number of additional antenna elements, ΔN, to be 8 additional cells on the next larger square. In one embodiment, this number is constant for the entire aperture. In one embodiment, the ratio of cellpitch1 (CP1: ring to ring distance) to cellpitch2 (CP2: distance cell to cell along a ring) is given by:

$$\frac{CP1}{CP2} = \frac{\Delta N}{2\pi}$$

Thus, CP2 is a function of CP1 (and vice versa). The cellpitch ratio for the example in FIG. 7 is then $$\frac{CP1}{CP2} = \frac{8}{2\pi} = 1.2732$$

which means that the CP1 is larger than CP2.

In one embodiment, to perform the transformation, a starting point on each square, such as starting point 721 on square 701, is selected and the antenna element associated with that starting point is placed on one position of its corresponding ring, such as starting point 731 on ring 711. For example, the x-axis or y-axis may be used as the starting point. Thereafter, the next element on the square proceeding in one direction (clockwise or counterclockwise) from the starting point is selected and that element placed on the next location on the ring going in the same direction (clockwise or counterclockwise) that was used in the square. This process is repeated until the locations of all the antenna elements have been assigned positions on the ring. This entire square to ring transformation process is repeated for all squares.

Figure 8:
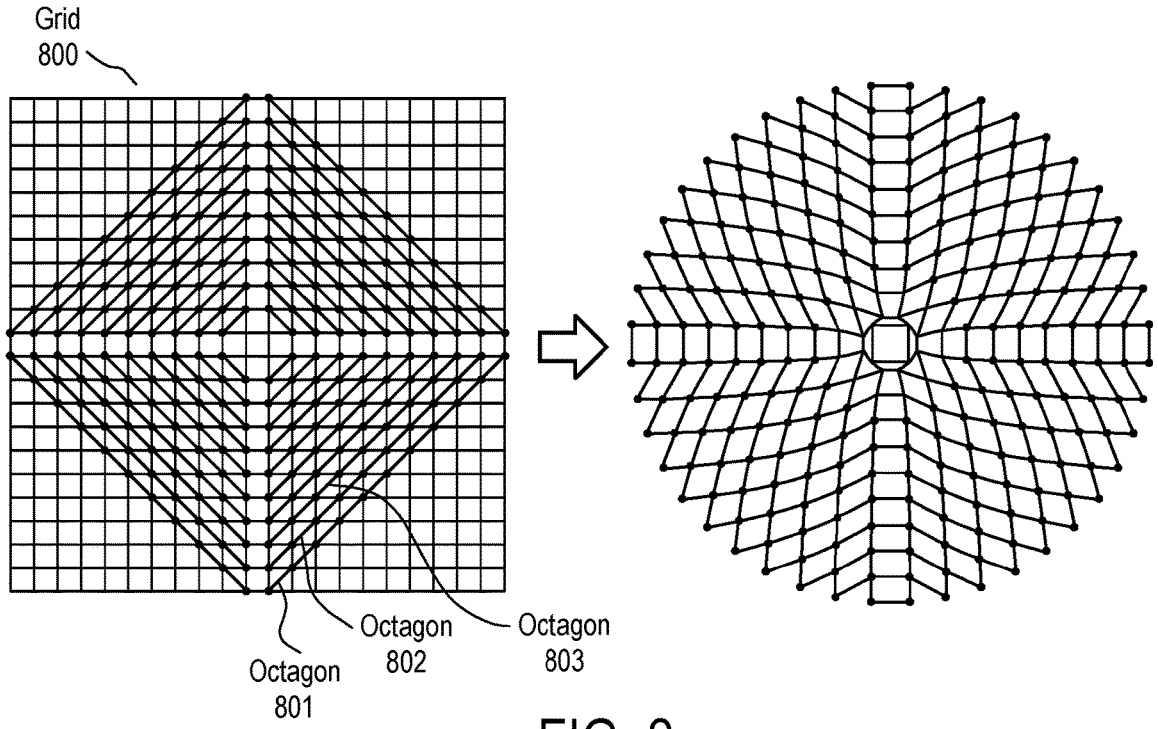
FIG. 8 shows an example where cells are grouped to form concentric octagons.

However, according to analytical studies and routing constraints, it is preferred to apply a CP2 larger than CP1. To accomplish this, a second strategy shown in FIG. 8 is used. Referring to FIG. 8, the cells are grouped initially into octagons, such as octagons 801-803, with respect to a grid 800. By grouping the cells into octagons, the number of additional antenna elements ΔN equals 4, which gives a ratio:

$$\frac{CP1}{CP2} = \frac{4}{2\pi} = 0.6366$$

which results in CP2>CP1.

The transformation from octagon to concentric rings for cell placement according to FIG. 8 can be performed in the same manner as that described above with respect to FIG. 7 by initially selecting a starting point.

Note that the cell placements disclosed with respect to FIGS. 7 and 8 have a number of features. These features include:

1) A constant CP1/CP2 over the entire aperture (Note that in one embodiment an antenna that is substantially constant (e.g., being 90% constant) over the aperture will still function);
2) CP2 is a function of CP1;
3) There is a constant increase per ring in the number of antenna elements as the ring distance from the centrally located antenna feed increases;
4) All the cells are connected to rows and columns of the matrix;
5) All the cells have unique addresses;
6) The cells are placed on concentric rings; and
7) There is rotational symmetry in that the four quadrants are identical and a ¼ wedge can be rotated to build out the array. This is beneficial for segmentation.

Note that while two shapes are given, other shapes may be used. Other increments are possible (e.g., 6 increments).

Figure 9:
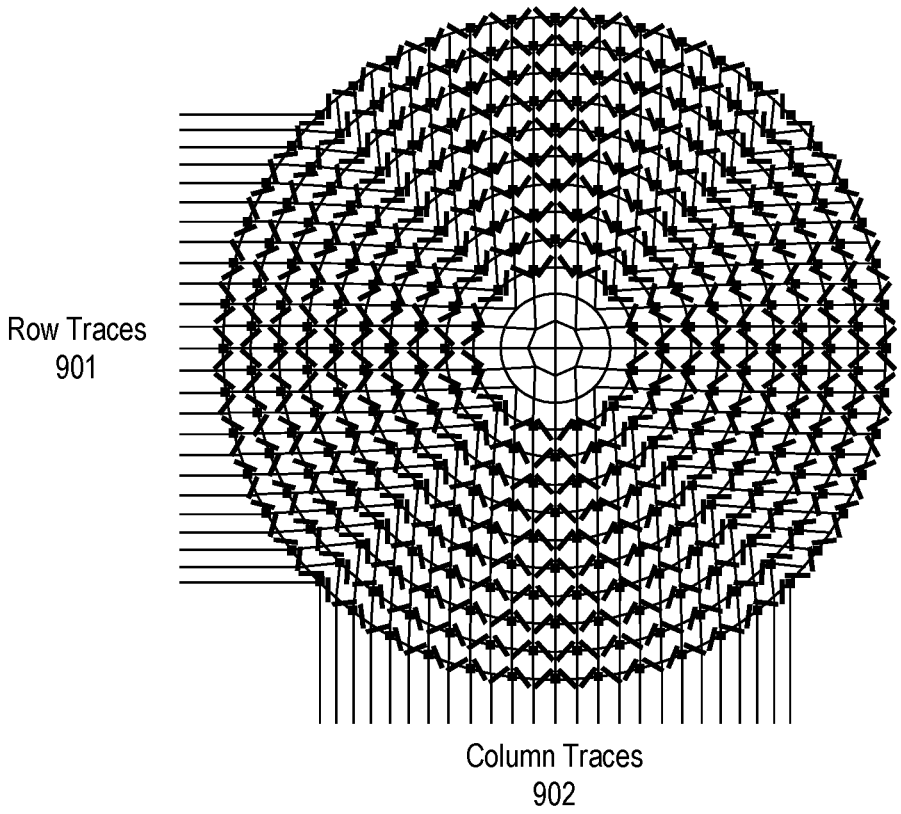
FIG. 9 shows an example of a small aperture including the irises and the matrix drive circuitry.

FIG. 9 shows an example of a small aperture including the irises and the matrix drive circuitry. The row traces 901 and column traces 902 represent row connections and column connections, respectively. These lines describe the matrix drive network and not the physical traces (as physical traces may have to be routed around antenna elements, or parts thereof). The square next to each pair of irises is a transistor.

FIG. 9 also shows the potential of the cell placement technique for using dual-transistors where each component drives two cells in a PCB array. In this case, one discrete device package contains two transistors, and each transistor drives one cell.

Figure 18:
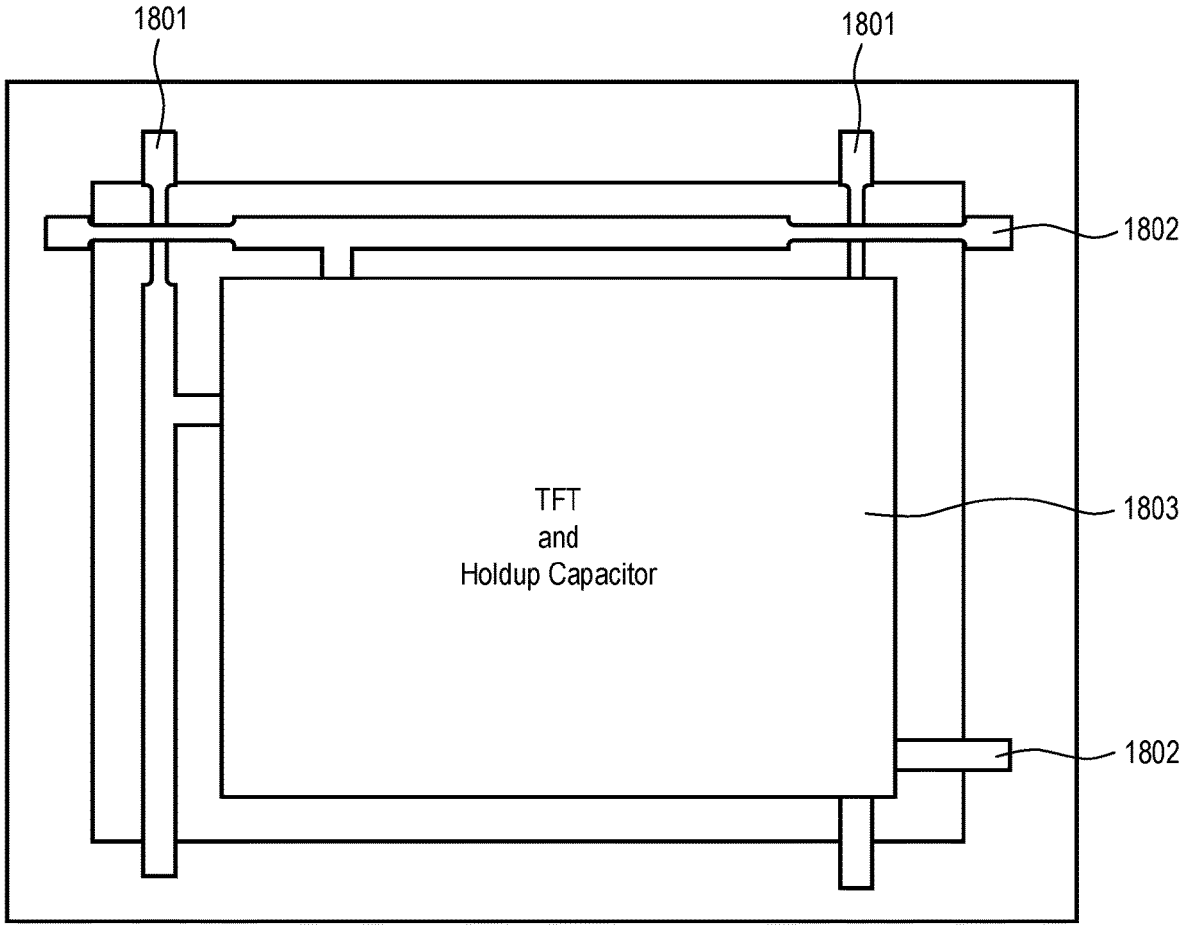
FIG. 18 illustrates one embodiment of a TFT package.

In one embodiment, a TFT package is used to enable placement and unique addressing in the matrix drive. FIG. 18 illustrates one embodiment of a TFT package. Referring to FIG. 18, a TFT and a hold capacitor 1803 is shown with input and output ports. There are two input ports connected to traces 1801 and two output ports connected to traces 1802 to connect the TFTs together using the rows and columns. In one embodiment, the row and column traces cross in 90° angles to reduce, and potentially minimize, the coupling between the row and column traces. In one embodiment, the row and column traces are on different layers.

Another important feature of the proposed cell placement shown in FIGS. 7-9 is that the layout is a repeating pattern in which each quarter of the layout is the same as the others. This allows the sub-section of the array to be repeated rotation-wise around the location of the central antenna feed, which in turn allows a segmentation of the aperture into sub-apertures. This helps in fabricating the antenna aperture.

In another embodiment, the matrix drive circuitry and cell placement on the cylindrical feed antenna is accomplished in a different manner. To realize matrix drive circuitry on the cylindrical feed antenna, a layout is realized by repeating a subsection of the array rotation-wise. This embodiment also allows the cell density that can be used for illumination tapering to be varied to improve the RF performance.

Figure 10:
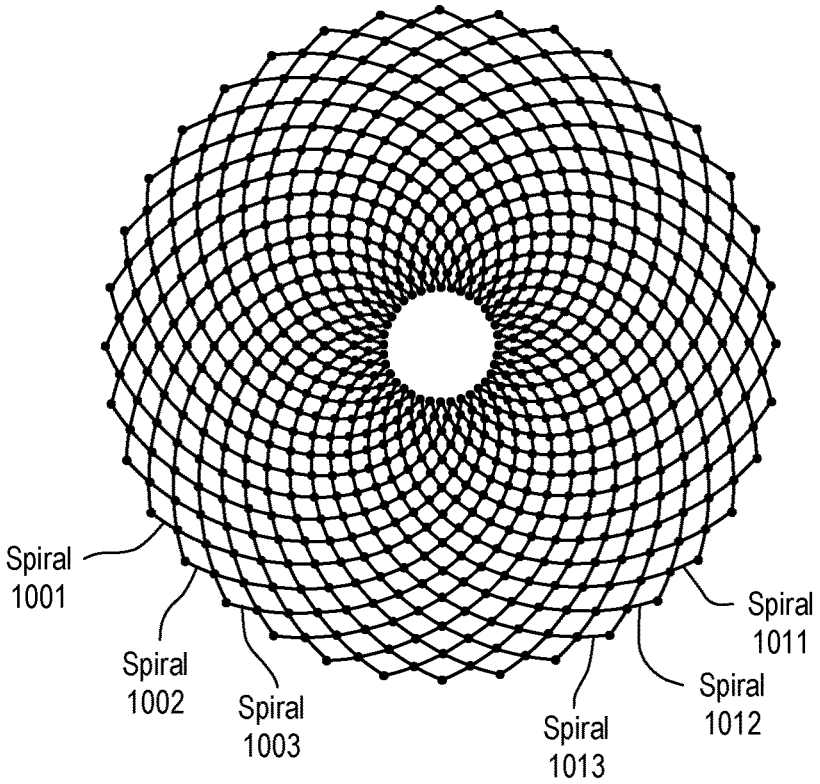
FIG. 10 shows an example of lattice spirals used for cell placement.

In this alternative approach, the placement of cells and transistors on a cylindrical feed antenna aperture is based on a lattice formed by spiral shaped traces. FIG. 10 shows an example of such lattice clockwise spirals, such as spirals 1001-1003, which bend in a clockwise direction and the spirals, such as spirals 1011-1013, which bend in a clockwise, or opposite, direction. The different orientation of the spirals results in intersections between the clockwise and counterclockwise spirals. The resulting lattice provides a unique address given by the intersection of a counterclockwise trace and a clockwise trace and can therefore be used as a matrix drive lattice. Furthermore, the intersections can be grouped on concentric rings, which is crucial for the RF performance of the cylindrical feed antenna.

Unlike the approaches for cell placement on the cylindrical feed antenna aperture discussed above, the approach discussed above in relation to FIG. 10 provides a non-uniform distribution of the cells. As shown in FIG. 10, the distance between the cells increases with the increase in radius of the concentric rings. In one embodiment, the varying density is used as a method to incorporate an illumination tapering under control of the controller for the antenna array.

Figure 11:
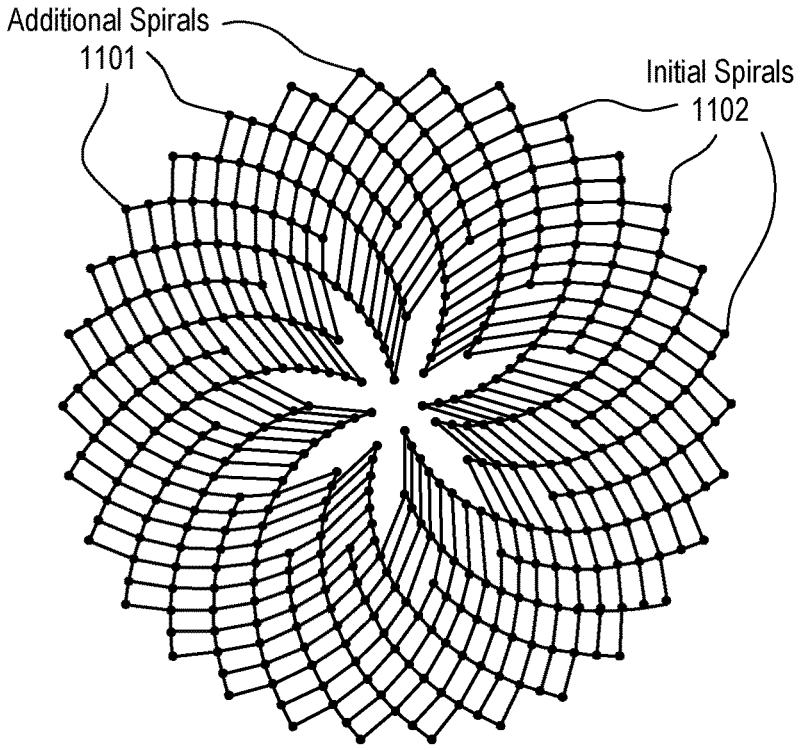
FIG. 11 shows an example of cell placement that uses additional spirals to achieve a more uniform density.

Due to the size of the cells and the required space between them for traces, the cell density cannot exceed a certain number. In one embodiment, the distance is λ/5 based on the frequency of operation. As described above, other distances may be used. In order to avoid an overpopulated density close to the center, or in other words to avoid an under-population close to the edge, additional spirals can be added to the initial spirals as the radius of the successive concentric rings increases. FIG. 11 shows an example of cell placement that uses additional spirals to achieve a more uniform density. Referring to FIG. 11, additional spirals, such as additional spirals 1101, are added to the initial spirals, such as spirals 1102, as the radius of the successive concentric rings increases. According to analytical simulations, this approach provides an RF performance that converges the performance of an entirely uniform distribution of cells. Note that this design provides a better sidelobe behavior because of the tapered element density than some embodiments described above.

Figure 12:
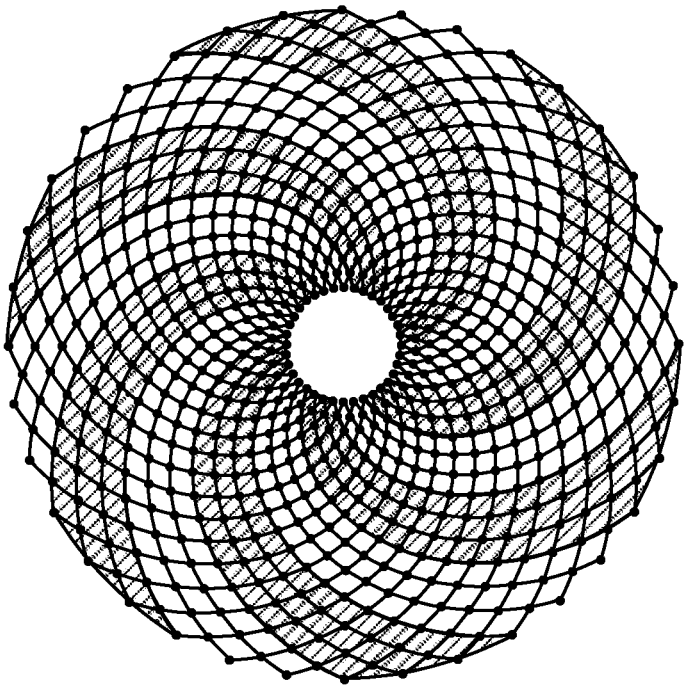
FIG. 12 illustrates a selected pattern of spirals that is repeated to fill the entire aperture.

Another advantage of the use of spirals for cell placement is the rotational symmetry and the repeatable pattern which can simplify the routing efforts and reducing fabrication costs. FIG. 12 illustrates a selected pattern of spirals that is repeated to fill the entire aperture.

Note that the cell placements disclosed with respect to FIGS. 10-12 have a number of features. These features include:

1) CP1/CP2 is not over the entire aperture;
2) CP2 is a function of CP1;
3) There is no increase per ring in the number of antenna elements as the ring distance from the centrally located antenna feed increases;
4) All the cells are connected to rows and columns of the matrix;
5) All the cells have unique addresses;
6) The cells are placed on concentric rings; and
7) There is rotational symmetry (as described above).

Thus, the cell placement embodiments described above in conjunction with FIGS. 10-12 have many similar features to the cell placement embodiments described above in conjunction with FIGS. 7-9.

Aperture Segmentation

In one embodiment, the antenna aperture is created by combining multiple segments of antenna elements together. This requires that the array of antenna elements be segmented and the segmentation ideally requires a repeatable footprint pattern of the antenna. In one embodiment, the segmentation of a cylindrical feed antenna array occurs such that the antenna footprint does not provide a repeatable pattern in a straight and inline fashion due to the different rotation angles of each radiating element. One goal of the segmentation approach disclosed herein is to provide segmentation without compromising the radiation performance of the antenna.

While segmentation techniques described herein focuses improving, and potentially maximizing, the surface utilization of industry standard substrates with rectangular shapes, the segmentation approach is not limited to such substrate shapes.

In one embodiment, segmentation of a cylindrical feed antenna is performed in a way that the combination of four segments realize a pattern in which the antenna elements are placed on concentric and closed rings. This aspect is important to maintain the RF performance. Furthermore, in one embodiment, each segment requires a separate matrix drive circuitry.

Figure 13:
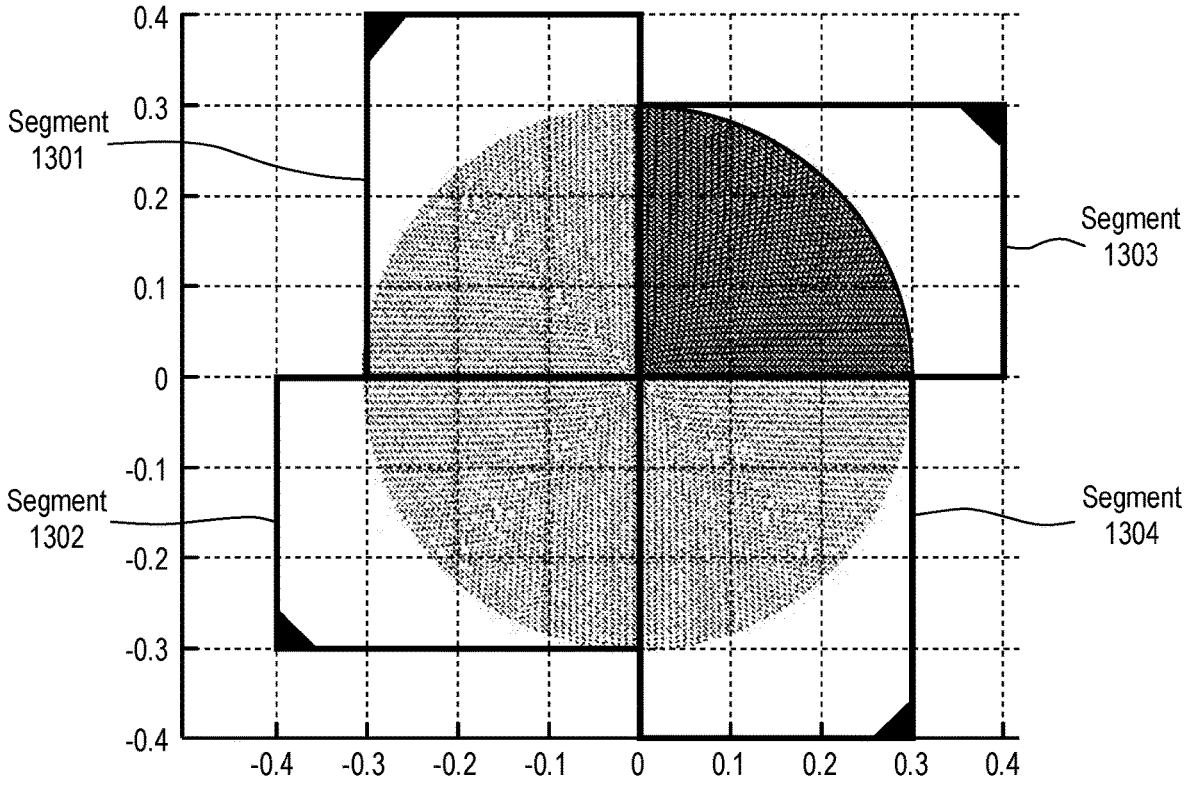
FIG. 13 illustrates one embodiment of segmentation of a cylindrical feed aperture into quadrants.

FIG. 13 illustrates segmentation of a cylindrical feed aperture into quadrants. Referring to FIG. 13, segments 1301-1304 are identical quadrants that are combined to build a round antenna aperture. The antenna elements on each of segments 1301-1304 are placed in portions of rings that form concentric and closed rings when segments 1301-1304 are combined. To combine the segments, segments will be mounted or laminated to a carrier. In another embodiment, overlapping edges of the segments are used to combine them together. In this case, in one embodiment, a conductive bond is created across the edges to prevent RF from leaking. Note that the element type is not affected by the segmentation.

As the result of this segmentation method illustrated in FIG. 13, the seams between segments 1301-1304 meet at the center and go radially from the center to the edge of the antenna aperture. This configuration is advantageous since the generated currents of the cylindrical feed propagate radially and a radial seam has a low parasitic impact on the propagated wave.

Figure 14A:
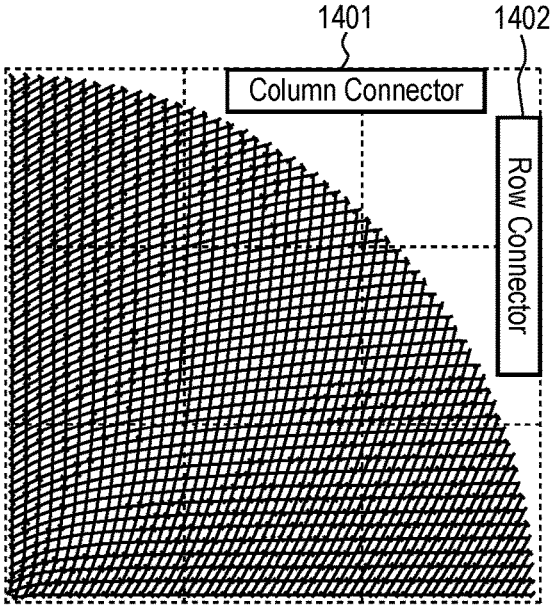
FIGS. 14A and 14B illustrate a single segment of FIG. 13 with the applied matrix drive lattice.
Figure 14B:
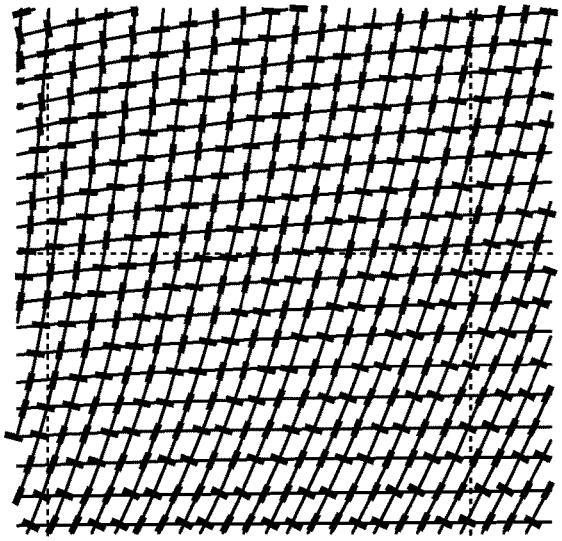

As shown in FIG. 13, rectangular substrates, which are a standard in the LCD industry, can also be used to realize an aperture. FIGS. 14A and 14B illustrate a single segment of FIG. 13 with the applied matrix drive lattice. The matrix drive lattice assigns a unique address to each of transistor. Referring to FIGS. 14A and 14B, a column connector 1401 and row connector 1402 are coupled to drive lattice lines. FIG. 14B also shows irises coupled to lattice lines.

Figure 15:
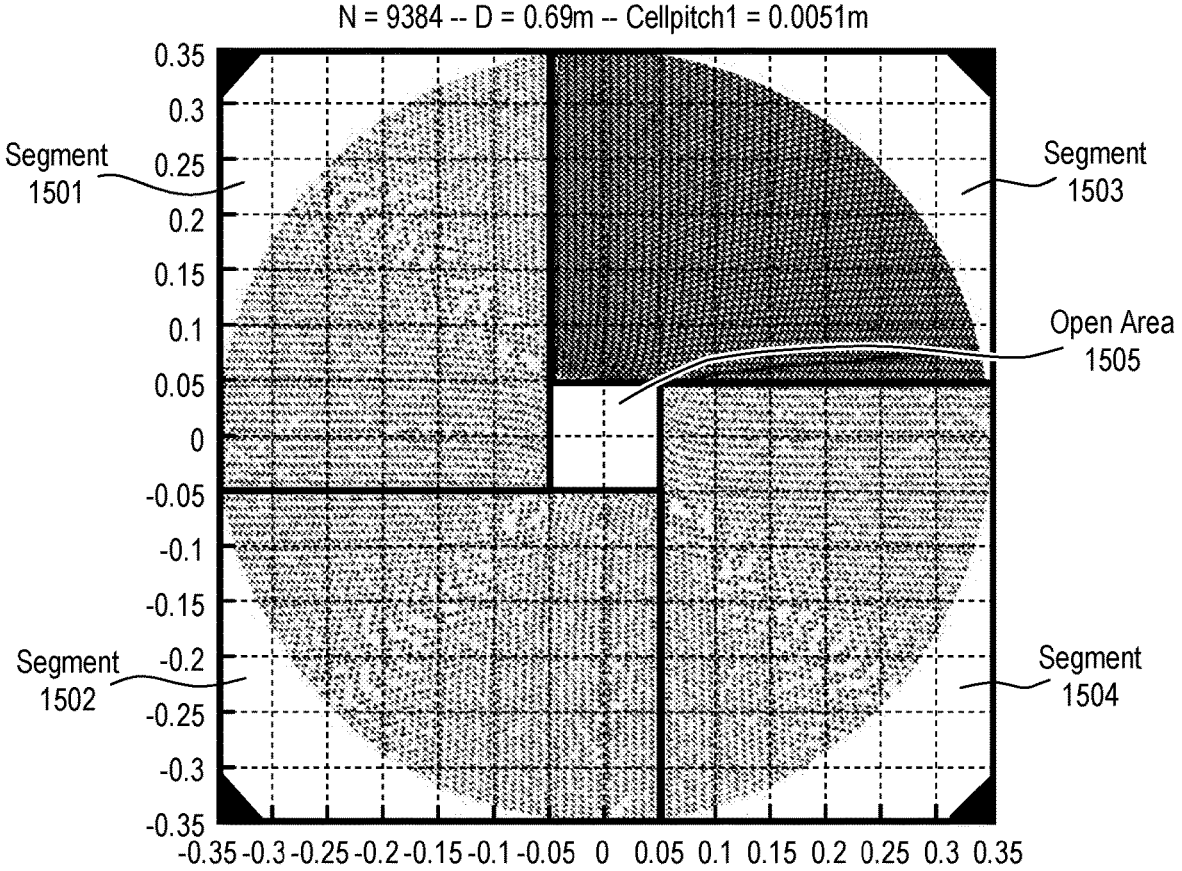
FIG. 15 illustrates another embodiment of segmentation of a cylindrical feed aperture into quadrants.

As is evident from FIG. 13, a large area of the substrate surface cannot be populated if a non-square substrate is used. In order to have a more efficient usage of the available surface on a non-square substrate, in another embodiment, the segments are on rectangular boards but utilize more of the board space for the segmented portion of the antenna array. One example of such an embodiment is shown in FIG. 15. Referring to FIG. 15, the antenna aperture is created by combining segments 1501-1504, which comprises substrates (e.g., boards) with a portion of the antenna array included therein. While each segment does not represent a circle quadrant, the combination of four segments 1501-1504 closes the rings on which the elements are placed. That is, the antenna elements on each of segments 1501-1504 are placed in portions of rings that form concentric and closed rings when segments 1501-1504 are combined. In one embodiment, the substrates are combined in a sliding tile fashion, so that the longer side of the non-square board introduces a rectangular keep-out area, referred to as open area 1505. Open area 1505 is where the centrally located antenna feed is located and included in the antenna.

The antenna feed is coupled to the rest of the segments when the open area exists because the feed comes from the bottom, and the open area can be closed by a piece of metal to prevent radiation from the open area. A termination pin may also be used.

The use of substrates in this fashion allows use of the available surface area more efficiently and results in an increased aperture diameter.

Figure 16A:
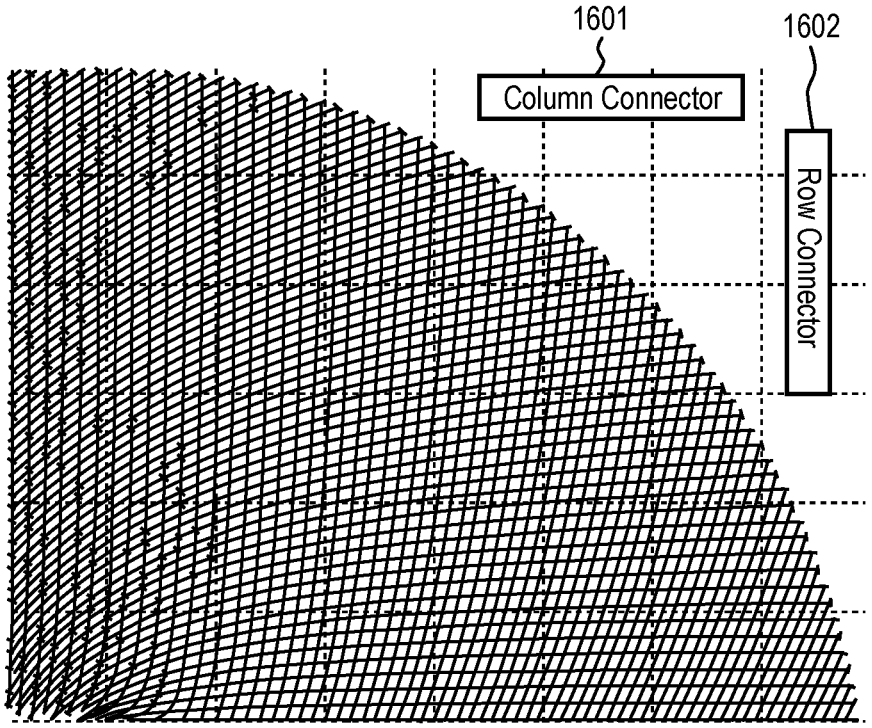
FIGS. 16A and 16B illustrate a single segment of FIG. 15 with the applied matrix drive lattice.
Figure 16B:
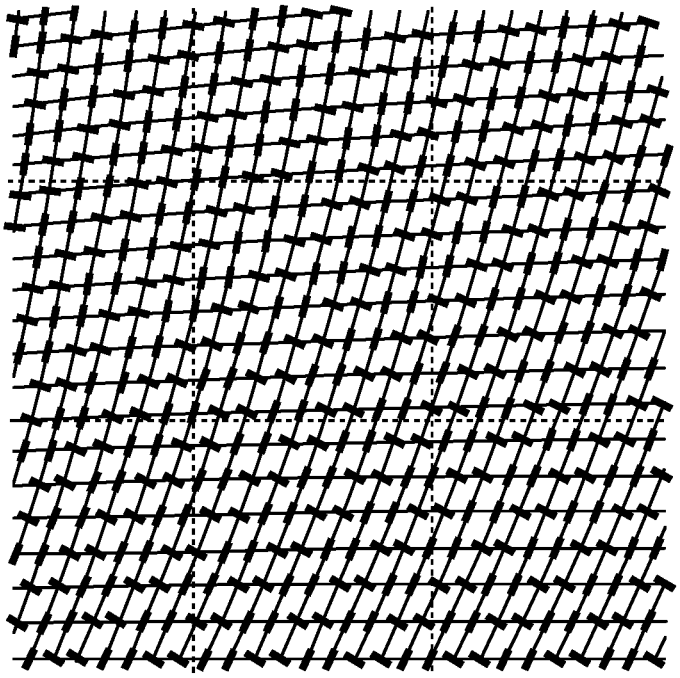

Similar to the embodiment shown in FIGS. 13, 14A and 14B, this embodiment allows use of a cell placement strategy to obtain a matrix drive lattice to cover each cell with a unique address. FIGS. 16A and 16B illustrate a single segment of FIG. 15 with the applied matrix drive lattice. The matrix drive lattice assigns a unique address to each of transistor. Referring to FIGS. 16A and 16B, a column connector 1601 and row connector 1602 are coupled to drive lattice lines. FIG. 16B also shows irises.

For both approaches described above, the cell placement may be performed based on a recently disclosed approach which allows the generation of matrix drive circuitry in a systematic and predefined lattice, as described above.

Figure 19A:
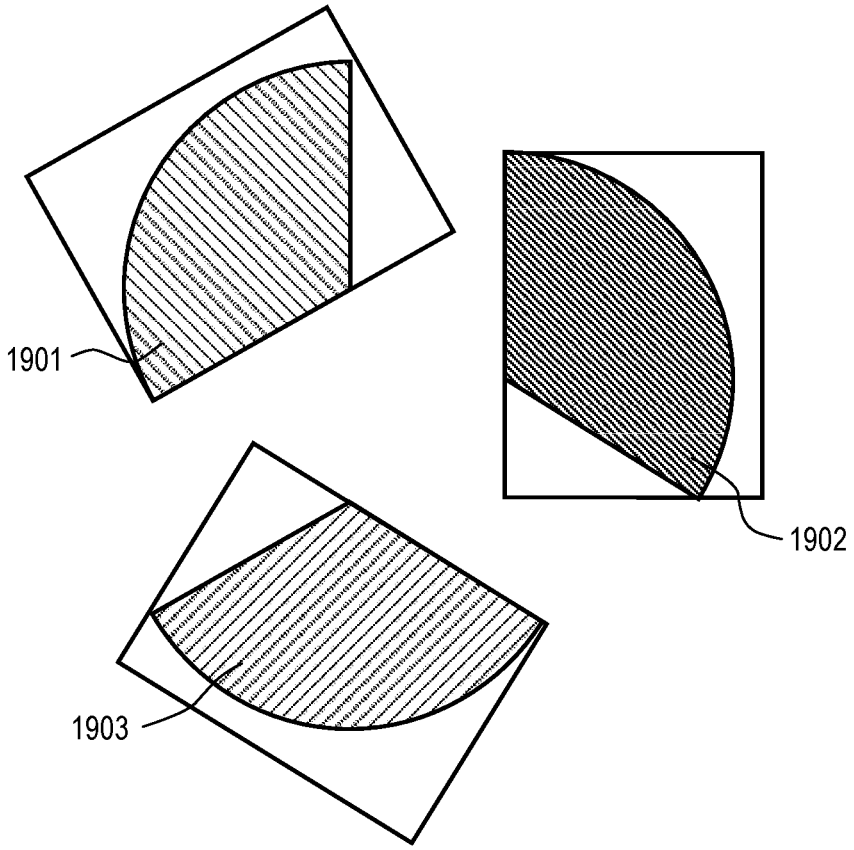
FIGS. 19A and B illustrate one example of an antenna aperture with an odd number of segments.
Figure 19B:
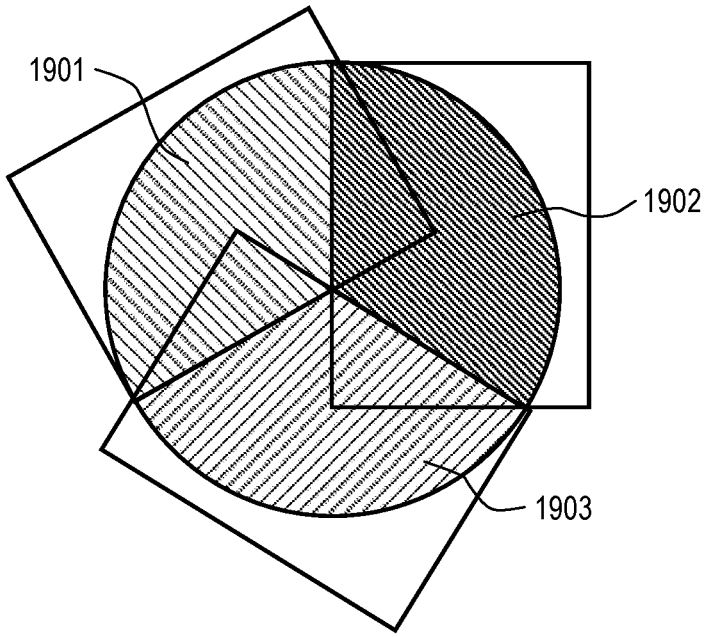

While the segmentations of the antenna arrays above are into four segments, this is not a requirement. The arrays may be divided into an odd number of segments, such as, for example, three segments or five segments. FIGS. 19A and B illustrate one example of an antenna aperture with an odd number of segments. Referring to FIG. 19A, there are three segments, segments 1901-1903, that are not combined. Referring to FIG. 19B, the three segments, segments 1901-1903, when combined, form the antenna aperture. These arrangements are not advantageous because the seams of all the segments do not go all the way through the aperture in a straight line. However, they do mitigate sidelobes.

In a first example embodiment, the flat panel antenna comprises an antenna feed to input a cylindrical feed wave; a single physical antenna aperture having at least one antenna array of antenna elements, wherein the antenna elements are located on a plurality of concentric rings concentrically located relative to an antenna feed, where rings of the plurality of concentric rings are separated by a ring-to-ring distance, wherein a first distance between elements along rings of the plurality of concentric rings is a function of a second distance between rings of the plurality of concentric rings; and a controller to control each antenna element of the array separately using matrix drive circuitry, each of the antenna elements being uniquely addressed by the matrix drive circuitry.

In another example embodiment, the subject matter of the first example embodiment can optionally include that the array of antenna elements has rotational symmetry.

In another example embodiment, the subject matter of the first example embodiment can optionally include that a ratio of second distance to the first distance is constant over the antenna aperture.

In another example embodiment, the subject matter of the first example embodiment can optionally include that each ring in the plurality of concentric rings has a number of additional elements over an adjacent ring that is closer to the cylindrical feed, and the number of additional elements is constant.

In another example embodiment, the subject matter of the first example embodiment can optionally include that rings of the plurality of rings have an identical number of antenna elements.

In another example embodiment, the subject matter of the first example embodiment can optionally include that elements on each ring of the plurality of concentric rings are positioned based on locations on a rectangular grid representation of the elements.

In another example embodiment, the subject matter of the first example embodiment can optionally include that elements on each ring of the plurality of concentric rings are positioned based on locations on an octagon representation of the elements.

In another example embodiment, the subject matter of the first example embodiment can optionally include that the first distance between the elements along rings of the plurality of ring is based on a frequency of operation of the antenna aperture.

In another example embodiment, the subject matter of the first example embodiment can optionally include that placement of each antenna element forms multiple spirals. In another example embodiment, the subject matter of this example embodiment can optionally include that placement of antenna elements on the plurality of concentric rings forms first and second sets of spirals of antenna elements, the first set of spirals bending in a clockwise direction and the second set of spirals bending in a counterclockwise direction. In another example embodiment, the subject matter of this example embodiment can optionally include that the first and second sets of spirals in one section of the aperture represent a repeated pattern of antenna elements that occurs a plurality of instances throughout the aperture array rotation-wise.

In another example embodiment, the subject matter of the first example embodiment can optionally include that the layout of the plurality of antenna elements comprises four groups of antenna elements, each group of antenna elements having an equal number of antenna elements laid out as one pattern such that a combination of the four groups forms concentric rings of antenna elements.

In another example embodiment, the subject matter of the first example embodiment can optionally include that the controller applies a control pattern to control which antenna elements are on and off to perform holographic beam forming.

In another example embodiment, the subject matter of the first example embodiment can optionally include that each of the at least one antenna array comprises a tunable slotted array of antenna elements. In another example embodiment, the subject matter of this example embodiment can optionally include that the tunable slotted array comprises a plurality of slots and further wherein each slot is tuned to provide a desired scattering at a given frequency. In another example embodiment, the subject matter of this example embodiment can optionally include that each slot of the plurality of slots is oriented either +45 degrees or −45 degrees relative to the cylindrical feed wave impinging at a central location of each said slot, such that the slotted array includes a first set of slots rotated +45 degrees relative to the cylindrical feed wave propagation direction and a second set of slots rotated −45 degrees relative to the propagation direction of the cylindrical feed wave.

In another example embodiment, the subject matter of the first example embodiment can optionally include that the tunable slotted array comprises: a plurality of slots; a plurality of patches, wherein each of the patches is co-located over and separated from a slot in the plurality of slots, forming a patch/slot pair, each patch/slot pair being turned off or on based on application of a voltage to the patch in the pair; and a controller that applies a control pattern that controls which patch/slot pairs are on and off to cause generation of a beam.

In a second example embodiment, a method for forming an array of antenna elements comprises assigning unique drive addresses to antenna elements in a plurality of groups of antenna elements by grouping antenna elements into the plurality of groups as placement of such antenna elements would be on non-circular concentric grids, with each group of antenna elements having an associated placement on one of the non-circular concentric grids; and laying out antenna elements into concentric rings, where antenna elements of each group associated with one of the non-circular concentric grids is placed in one of the concentric rings.

In another example embodiment, the subject matter of the second example embodiment can optionally include that the non-circular concentric grids comprise concentric rectangular grids evenly spaced apart. In another example embodiment, the subject matter of this example embodiment can optionally include that the concentric rectangular grids are concentric square grids.

In another example embodiment, the subject matter of the second example embodiment can optionally include that the non-circular concentric grids comprise concentric octagon grids evenly spaced apart.

In another example embodiment, the subject matter of the second example embodiment can optionally include that laying out antenna elements comprises placing antenna elements on the plurality of concentric rings thereby forming first and second sets of spirals of antenna elements, the first set of spirals bending in a clockwise direction and the second set of spirals bending in a counterclockwise direction. In another example embodiment, the subject matter of this example embodiment can optionally include that the first and second sets of spirals in one section of the aperture represent a repeated pattern of antenna elements that occurs a plurality of instances throughout the aperture array rotation-wise.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as essential to the invention.

We claim:

1. A flat panel antenna comprising:

an antenna feed;

a single physical antenna aperture having at least one antenna array of antenna elements, wherein each of the antenna elements is operable to radiate radio frequency (RF) energy and the antenna elements are located in a pattern relative to the antenna feed; and a controller coupled to the at least one antenna array to apply voltages to the antenna elements of the array using matrix drive circuitry, each of the antenna elements being uniquely addressed by the matrix drive circuitry, wherein the matrix drive circuitry is configured to apply voltages to patches of the antenna elements.

2. The antenna defined in claim 1 wherein the controller is configured to drive a holographic diffraction pattern onto antenna elements of the at least one antenna array.

3. The antenna defined in claim 1 wherein the pattern has rotational symmetry with respect to the feed.

4. The antenna defined in claim 1 wherein the antenna elements are located in a plurality of concentric rings concentrically located relative to an antenna feed.

5. The antenna defined in claim 4 wherein rings of the plurality of concentric rings are separated by a ring-to-ring distance, wherein a first distance between elements along rings of the plurality of concentric rings is a function of a second distance between rings of the plurality of concentric rings.

6. The antenna defined in claim 1 wherein the antenna elements are positioned based on locations on a rectangular grid representation of the antenna elements or on locations on an octagon representation of the antenna elements.

7. The antenna defined in claim 1 wherein antenna elements are located in a pattern having multiple spirals.

8. The antenna defined in claim 7 wherein placement of antenna elements forms first and second sets of spirals of antenna elements, the first set of spirals bending in a clockwise direction and the second set of spirals bending in a counterclockwise direction.

9. The antenna defined in claim 1 wherein layout of the plurality of antenna elements comprises four groups of antenna elements, each group of antenna elements having an equal number of antenna elements laid out as one pattern with the antenna elements in which combination of patterns of the four groups is rotationally symmetric about a point in the antenna aperture.

10. The antenna defined in claim 9 wherein the at least one antenna array comprises a slotted array of antenna elements, the slotted array comprising a plurality of slots with each slot being tuned to provide a desired scattering at a given frequency.

11. The antenna defined in claim 10 wherein the tunable slotted array further comprises a plurality of patches, wherein each of the patches is co-located over and separated from a slot in the plurality of slots to form a patch/slot pair, each patch/slot pair being controlled based on application of a voltage to the patch in the pair; and further wherein the controller is configured to apply a control pattern to controls patch/slot pairs to cause generation of a beam.

12. A flat panel antenna comprising:

a single physical antenna aperture having at least one antenna array of antenna elements, wherein each of the antenna elements is operable to radiate radio frequency (RF) energy and the antenna elements are located in a pattern; and matrix drive circuitry coupled to the at least one antenna array to apply voltages to the antenna elements of the array, each of the antenna elements being uniquely addressed by the matrix drive circuitry, wherein the matrix drive circuitry is configured to apply voltages to patches of the antenna elements.

13. The antenna defined in claim 12 further comprising a controller configured to drive a holographic diffraction pattern onto antenna elements of the at least one antenna array.

* * * * *